US008511400B2

(12) United States Patent
Catoi et al.

(10) Patent No.: US 8,511,400 B2
(45) Date of Patent: Aug. 20, 2013

(54) APPARATUS AND METHOD FOR ACOUSTIC MEASUREMENTS WHILE USING A CORING TOOL

(75) Inventors: Olimpiu Adrian Catoi, Richmond, TX (US); Alejandro Martinez, Calgary (CA)

(73) Assignee: Schlumberger Technology Corporation, Sugar Land, TX (US)

( * ) Notice: Subject to any disclaimer, the term of this patent is extended or adjusted under 35 U.S.C. 154(b) by 351 days.

(21) Appl. No.: 12/754,080

(22) Filed: Apr. 5, 2010

(65) Prior Publication Data

US 2011/0240364 A1 Oct. 6, 2011

(51) Int. Cl.
*E21B 47/02* (2006.01)

(52) U.S. Cl.
USPC ..... 175/45; 175/50

(58) Field of Classification Search
USPC ..... 166/249, 255.2, 250.16, 66; 175/44, 175/244–255, 50
See application file for complete search history.

(56) References Cited

U.S. PATENT DOCUMENTS

| | | | | |
|---|---|---|---|---|
| 4,964,087 | A | 10/1990 | Widrow | |
| 5,138,857 | A | 8/1992 | Siegert | |
| 5,148,407 | A | 9/1992 | Haldorsen et al. | |
| 5,377,161 | A | 12/1994 | Meehan | |
| 5,501,285 | A | 3/1996 | Lamine et al. | |
| 5,667,025 | A * | 9/1997 | Haessly et al. | 175/78 |
| 6,006,844 | A * | 12/1999 | Van Puymbroeck et al. | 175/50 |
| 6,641,434 | B2 | 11/2003 | Boyle et al. | |
| 7,182,151 | B2 * | 2/2007 | Stump et al. | 175/45 |
| 2003/0015351 | A1 * | 1/2003 | Goldman et al. | 175/39 |
| 2004/0112594 | A1 * | 6/2004 | Aronstam et al. | 166/249 |
| 2005/0133267 | A1 * | 6/2005 | Reid et al. | 175/58 |
| 2007/0137894 | A1 | 6/2007 | Fujisawa et al. | |
| 2007/0215345 | A1 * | 9/2007 | Lafferty et al. | 166/250.1 |
| 2008/0066534 | A1 | 3/2008 | Reid et al. | |
| 2008/0251292 | A1 | 10/2008 | Desmette et al. | |
| 2009/0078467 | A1 * | 3/2009 | Castillo | 175/249 |
| 2009/0159335 | A1 | 6/2009 | Cravatte | |
| 2009/0166088 | A1 | 7/2009 | Jeffryes et al. | |

FOREIGN PATENT DOCUMENTS

| | | | |
|---|---|---|---|
| EP | 0795764 | B1 | 8/2000 |
| WO | 03/036042 | A1 | 5/2003 |

OTHER PUBLICATIONS

International Search Report and Written Opinion dated Nov. 28, 2011 for corresponding PCT Application No. PCT/US2011/031037 filed Apr. 4, 2011.

* cited by examiner

*Primary Examiner* — David Andrews
*Assistant Examiner* — Taras P Bemko
(74) *Attorney, Agent, or Firm* — Cathy Hewitt; John Vereb

(57) ABSTRACT

Embodiments disclosed herein relate to one or more embodiments and methods to make downhole measurements. Embodiments disclosed herein relate to one or more embodiments and methods to measure the movement generated by a coring tool. The methods and embodiments include disposing a coring tool in a wellbore, coupling a first wave detector to the coring tool, anchoring the coring tool to a formation surrounding the wellbore, operating the coring tool, measuring movement generated by the coring tool with the first wave detector, and outputting a signal based upon the measured movement measured with the first wave detector.

23 Claims, 10 Drawing Sheets

APPARATUS AND METHOD FOR ACOUSTIC MEASUREMENTS WHILE USING A CORING TOOL

BACKGROUND OF THE DISCLOSURE

Wells are generally drilled into the ground or ocean bed to recover natural deposits of oil and gas, as well as other desirable materials that are trapped in geological formations in the Earth's crust. Wells are typically drilled using a drill bit attached to the lower end of a "drill string." Drilling fluid, or mud, is typically pumped down through the drill string to the drill bit. The drilling fluid lubricates and cools the bit, and may additionally carry drill cuttings from the borehole back to the surface.

In various oil and gas exploration operations, it may be beneficial to have information about the subsurface formations that are penetrated by a borehole. For example, certain formation evaluation schemes include measurement and analysis of the formation velocity and seismic and/or acoustic properties. These measurements may be essential to predicting the production capacity and production lifetime of the subsurface formation.

Further, in addition to measuring and analyzing the formation velocity and seismic and/or acoustic properties, samples may also be taken of the formation rock within the borehole. For example, a coring tool may be used to take a coring sample of the formation rock within the borehole. The typical coring tool usually includes a hollow drill bit, such as a coring bit, that is advanced into the formation wall such that a sample, such as a coring sample, may be removed from the formation. Downhole coring operations generally include axial coring and sidewall coring. In axial coring, the coring tool may be disposed at the end of a drill string disposed within a borehole, in which the coring tool may be used to collect a coring sample at the bottom of the borehole. In sidewall coring, the coring bit from the coring tool may extend radially from the coring tool, in which the coring tool may be used to collect a coring sample from a side wall of the borehole.

As such, the coring sample may then be transported to the surface, in which the sample may be analyzed to assess, amongst other things, the reservoir storage capacity (porosity) and the permeability of the material that makes up the formation surrounding the borehole, such as the chemical and mineral composition of the fluids and mineral deposits contained in the pores of the formation and/or the irreducible water content contained in the formation.

BRIEF DESCRIPTION OF THE DRAWINGS

The present disclosure is best understood from the following detailed description when read with the accompanying figures. It is emphasized that, in accordance with the standard practice in the industry, various features are not drawn to scale. In fact, the dimensions of the various features may be arbitrarily increased or reduced for clarity of discussion.

DETAILED DESCRIPTION

Figure 1:
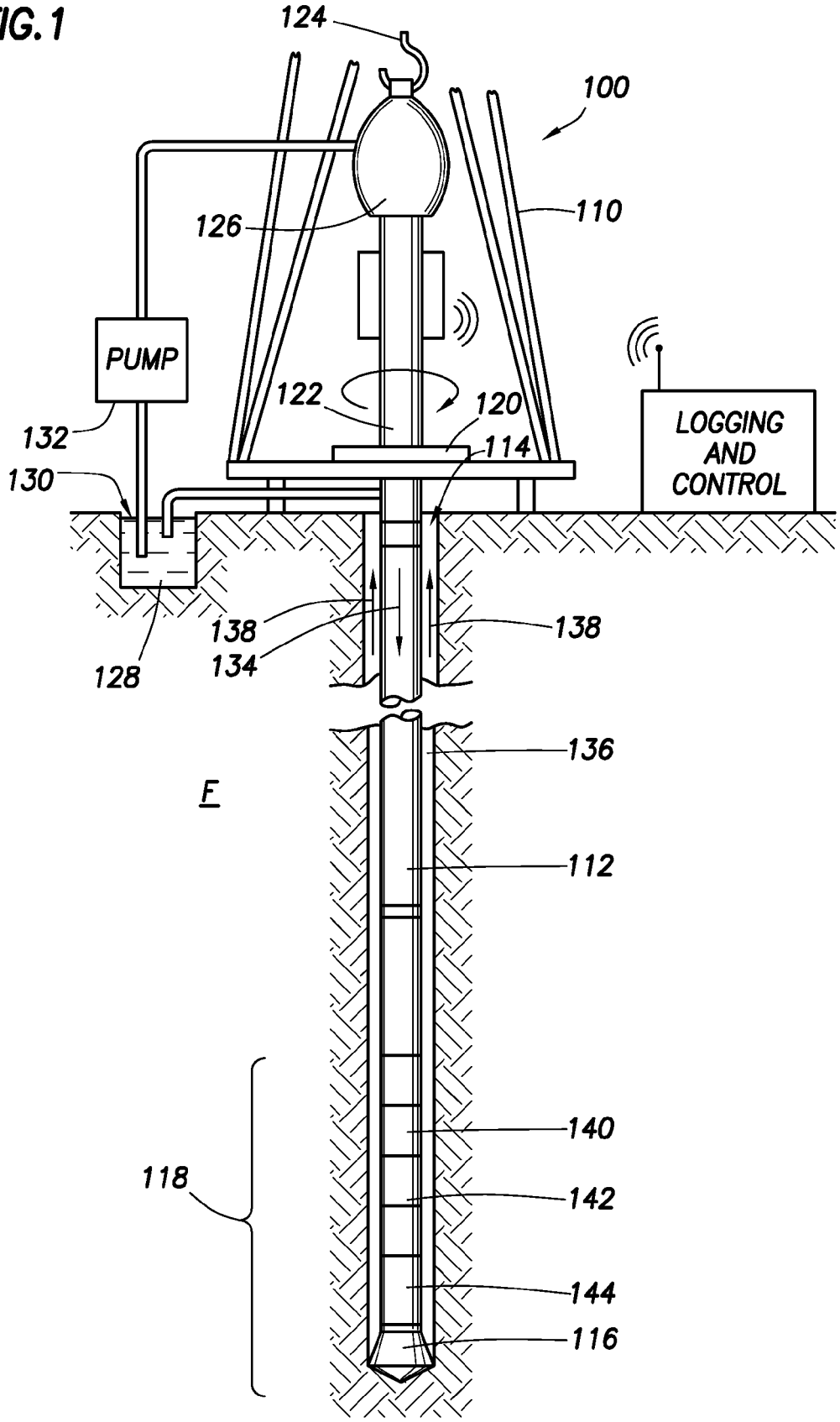
FIG. 1 shows a side view of a wellsite having a drilling rig with a drill string suspended therefrom in accordance with one or more embodiments of the present disclosure.

It is to be understood that the following disclosure provides many different embodiments, or examples, for implementing different features of various embodiments. Specific examples of components and arrangements are described below to simplify the present disclosure. These are, of course, merely examples and are not intended to be limiting. In addition, the present disclosure may repeat reference numerals and/or letters in the various examples. This repetition is for the purpose of simplicity and clarity and does not in itself dictate a relationship between the various embodiments and/or configurations discussed. Moreover, the formation of a first feature over or on a second feature in the description that follows may include embodiments in which the first and second features are formed in direct contact, and may also include embodiments in which additional features may be formed interposing the first and second features, such that the first and second features may not be in direct contact.

Referring now to FIG. 1, a side view of a wellsite 100 having a drilling rig 110 with a drill string 112 suspended therefrom in accordance with one or more embodiments of the present disclosure is shown. The wellsite 100 shown, or one similar thereto, may be used within onshore and/or offshore locations. In this embodiment, a borehole 114 may be formed within a subsurface formation F, such as by using rotary drilling, or any other method known in the art. As such, one or more embodiments in accordance with the present disclosure may be used within a wellsite, similar to the one as shown in FIG. 1 (discussed more below). Further, those having ordinary skill in the art will appreciate that the present disclosure may be used within other wellsites or drilling operations, such as within a directional drilling application, without departing from the scope of the present disclosure.

Continuing with FIG. 1, the drill string 112 may suspend from the drilling rig 110 into the borehole 114. The drill string 112 may include a bottom hole assembly 118 and a drill bit 116, in which the drill bit 116 may be disposed at an end of the drill string 112. The surface of the wellsite 100 may have the drilling rig 110 positioned over the borehole 114, and the drilling rig 110 may include a rotary table 120, a kelly 122, a traveling block or hook 124, and may additionally include a rotary swivel 126. The rotary swivel 126 may be suspended from the drilling rig 110 through the hook 124, and the kelly 122 may be connected to the rotary swivel 126 such that the kelly 122 may rotate with respect to the rotary swivel.

Further, an upper end of the drill string 112 may be connected to the kelly 122, such as by threadingly connecting the drill string 112 to the kelly 122, and the rotary table 120 may rotate the kelly 122, thereby rotating the drill string 112 connected thereto. As such, the drill string 112 may be able to rotate with respect to the hook 124. Those having ordinary skill in the art, however, will appreciate that though a rotary drilling system is shown in FIG. 1, other drilling systems may be used without departing from the scope of the present disclosure. For example, a top-drive (also known as a "power swivel") system may be used in accordance with one or more embodiments without departing from the scope of the present disclosure. In such a top-drive system, the hook 124, swivel 126, and kelly 122 are replaced by a drive motor (electric or hydraulic) that may apply rotary torque and axial load directly to drill string 112.

The wellsite 100 may further include drilling fluid 128 (also known as drilling "mud") stored in a pit 130. The pit 130 may be formed adjacent to the wellsite 100, as shown, in which a pump 132 may be used to pump the drilling fluid 128 into the wellbore 114. In this embodiment, the pump 132 may pump and deliver the drilling fluid 128 into and through a port of the rotary swivel 126, thereby enabling the drilling fluid 128 to flow into and downwardly through the drill string 112, the flow of the drilling fluid 128 indicated generally by direction arrow 134. This drilling fluid 128 may then exit the drill string 112 through one or more ports disposed within and/or fluidly connected to the drill string 112. For example, in this embodiment, the drilling fluid 128 may exit the drill string 112 through one or more ports formed within the drill bit 116.

As such, the drilling fluid 128 may flow back upwardly through the borehole 114, such as through an annulus 136 formed between the exterior of the drill string 112 and the interior of the borehole 114, the flow of the drilling fluid 128 indicated generally by direction arrow 138. With the drilling fluid 128 following the flow pattern of direction arrows 134 and 138, the drilling fluid 128 may be able to lubricate the drill string 112 and the drill bit 116, and/or may be able to carry formation cuttings formed by the drill bit 116 (or formed by any other drilling components disposed within the borehole 114) back to the surface of the wellsite 100. As such, this drilling fluid 128 may be filtered and cleaned and/or returned back to the pit 130 for recirculation within the borehole 114.

Though not shown in this embodiment, the drill string 112 may further include one or more stabilizing collars. A stabilizing collar may be disposed within and/or connected to the drill string 112, in which the stabilizing collar may be used to engage and apply a force against the wall of the borehole 114. This may enable the stabilizing collar to prevent the drill string 112 from deviating from the desired direction for the borehole 114. For example, during drilling, the drill string 112 may "wobble" within the borehole 114, thereby enabling the drill string 112 to deviate from the desired direction of the borehole 114. This wobble may also be detrimental to the drill string 112, components disposed therein, and the drill bit 116 connected thereto. However, a stabilizing collar may be used to minimize, if not overcome altogether, the wobble action of the drill string 112, thereby possibly increasing the efficiency of the drilling performed at the wellsite 100 and/or increasing the overall life of the components at the wellsite 100.

As discussed above, the drill string 112 may include a bottom hole assembly 118, such as by having the bottom hole assembly 118 disposed adjacent to the drill bit 116 within the drill string 112. The bottom hole assembly 118 may include one or more components therein, such as components to measure, process, and store information. Further, the bottom hole assembly 118 may include components to communicate and relay information to the surface of the wellsite.

As such, in this embodiment shown in FIG. 1, the bottom hole assembly 118 may include one or more logging-while-drilling ("LWD") tools 140 and/or one or more measuring-while-drilling ("MWD") tools 142. Further, the bottom hole assembly 118 may also include a steering-while-drilling system (e.g., a rotary-steerable system) and motor 144, in which the rotary-steerable system and motor 144 may be coupled to the drill bit 116.

The LWD tool 140 shown in FIG. 1 may include a thick-walled housing, commonly referred to as a drill collar, and may include one or more of a number of logging tools known in the art. Thus, the LWD tool 140 may be capable of measuring, processing, and/or storing information therein, as well as capabilities for communicating with equipment disposed at the surface of the wellsite 100.

Further, the MWD tool 142 may also include a housing (e.g., drill collar), and may include one or more of a number of measuring tools known in the art, such as tools used to measure characteristics of the drill string 112 and/or the drill bit 116. The MWD tool 142 may also include an apparatus for generating and distributing power within the bottom hole assembly 118. For example, a mud turbine generator powered by flowing drilling fluid therethrough may be disposed within the MWD tool 142. Alternatively, other power generating sources and/or power storing sources (e.g., a battery) may be disposed within the MWD tool 142 to provide power within the bottom hole assembly 118. As such, the MWD tool 142 may include one or more of the following measuring tools: a weight-on-bit measuring device, a torque measuring device, a vibration measuring device, a shock measuring device, a stick slip measuring device, a direction measuring device, an inclination measuring device, and/or any other device known in the art used within an MWD tool.

A coring tool according to one or more aspects of the present disclosure may be provided with the wellsite system 100. For example, the coring tool may be provided at the bit 116, with a tool of a type similar to the coring tool described in U.S. Patent Application Pub. No. 2009/0166088, included herein by reference. Alternatively or additionally, the coring tool may be provided as part of the LWD tool 140, with a tool of a type similar to the coring tool described in FIG. 2 herein. However, coring tool may be provided at other locations of the wellsite system 100 within the scope of the present disclosure. Furthermore, a wave detector in accordance with embodiments disclosed herein may be included in the wellsite 100, such as at one or more locations along the drill string 112, within a coring tool implemented in the LWD tool 140, within a coring tool implemented at the bit 116.

Figure 2:
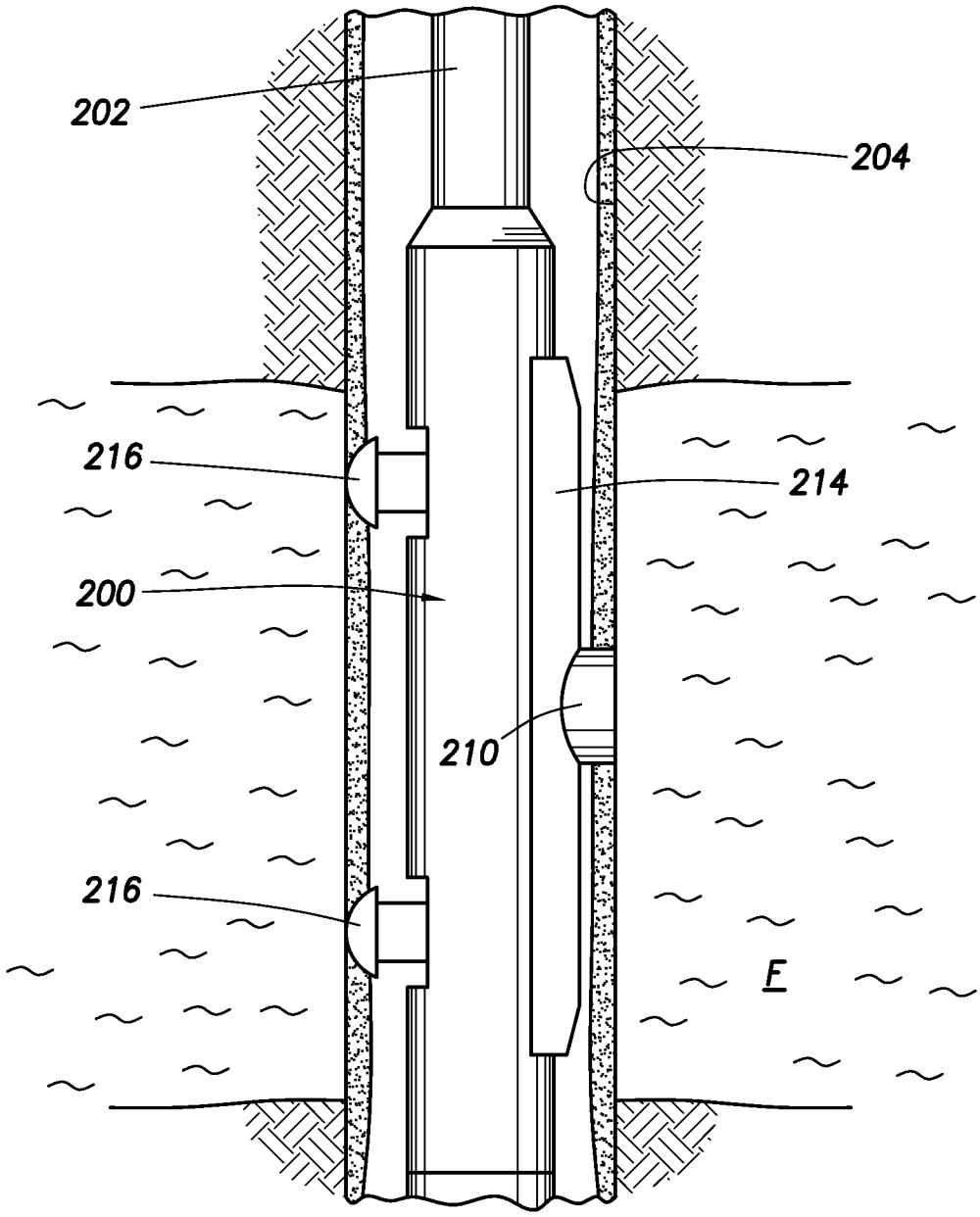
FIG. 2 shows a side view of a tool in accordance with one or more embodiments of the present disclosure.

Referring now to FIG. 2, a side view of a tool 200 in accordance with one or more embodiments of the present disclosure is shown. The tool 200 may be connected to and/or included within a drill string 202, in which the tool 200 may be disposed within a borehole 204 formed within a subsurface formation F. As such, the tool 200 may be included and used within a bottom hole assembly, as described above.

In this embodiment, the tool 200 may also include a stabilizer blade 214 and/or one or more pistons 216. As such, a coring tool 210 may be disposed on the stabilizer blade 214 and extend therefrom to engage the wall of the borehole 204. The pistons, if present, may also extend from the tool 200 to assist the coring tool 210 in engaging with the wall of the borehole 204. The coring tool 210 may be used to collect samples from the formation F, such as one or more coring samples from the wall of the borehole 204. Additionally, in one or more embodiments, a tool in accordance with embodiments disclosed herein may be used to formation fluid samples from the formation F.

As such, core samples may be drawn into the tool 200 using the coring tool 210, in which core sample properties may be measured to determine one or more parameters of the formation F. Additionally, the tool 200 may include one or more devices, such as sample core storage modules, that may be used to collect core samples. These core samples may be retrieved back at the surface with the tool 200. Furthermore, a wave detector in accordance with embodiments disclosed herein may be included, for example, within the coring tool 210.

Figure 3:
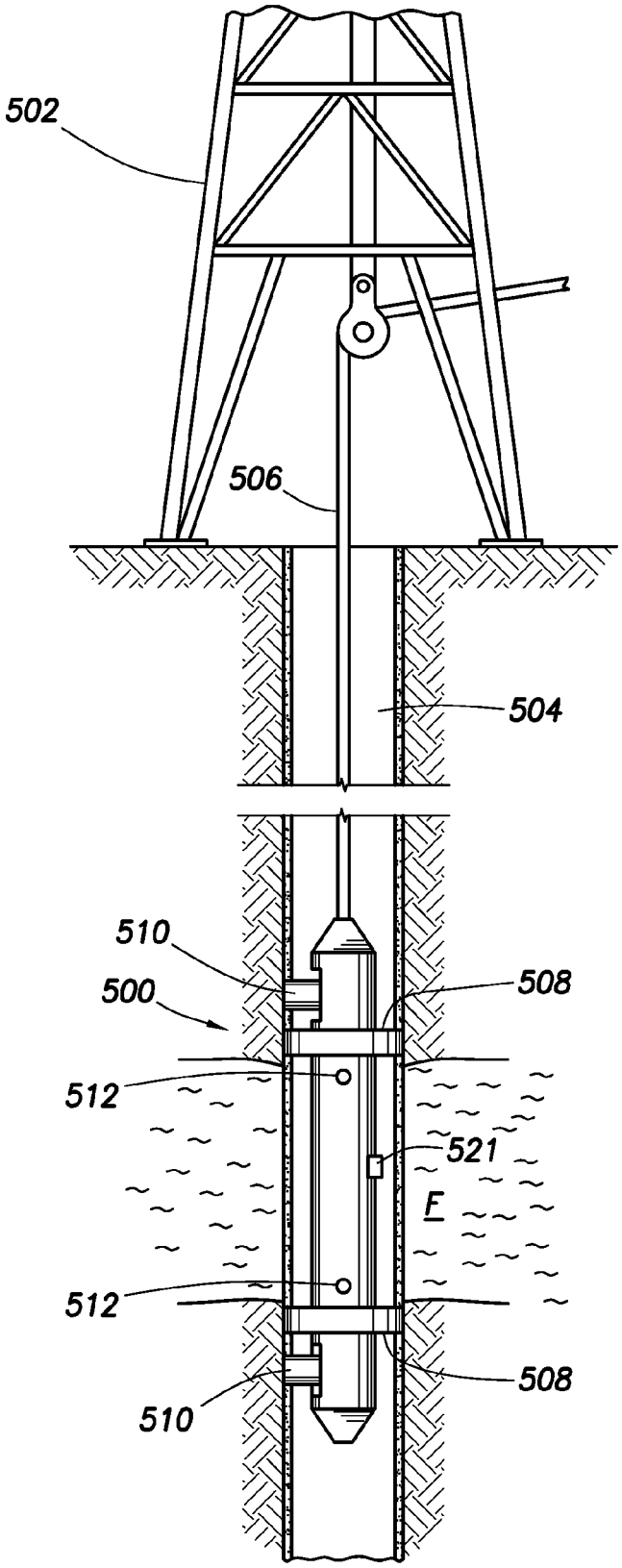
FIG. 3 shows a side view of a tool in accordance with one or more embodiments of the present disclosure.

Referring now to FIG. 3, a side view of another tool 500 in accordance with one or more embodiments of the present disclosure is shown. The tool 500 may be suspended within a borehole 504 formed within a subsurface formation F using a multi-conductor cable 506. In this embodiment, the multi-conductor cable 506 may be supported by a drilling rig 502.

As shown in this embodiment, the tool 500 may include one or more packers 508 that may be configured to inflate, thereby selectively sealing off a portion of the borehole 504 for the tool 500. Further, to test the formation F, the tool 500 may include one or more probes 510, and the tool 500 may also include one or more outlets 512 that may be used to draw and/or inject fluids within the sealed portion established by the packers 508 between the tool 500 and the formation F. For example, fluid may be injected within the sealed portion so that the formation F may be fractured.

The tool 500 may further include a coring tool 521. For example, the coring tool 521 may include a coring bit, in which the coring bit may have an open end for cutting into the formation F and receiving a coring sample. Further, the coring tool 521 may be able to extend and retract the coring bit into and out of the coring tool 521, and may also be able to rotate the coring bit against the wall of the borehole 504. Furthermore, a wave detector in accordance with embodiments disclosed herein may be included, for example, within the coring tool 521. The wave detector may be used, for example, to detect waves that may be generated during fracturing of the formation F.

Figure 4:
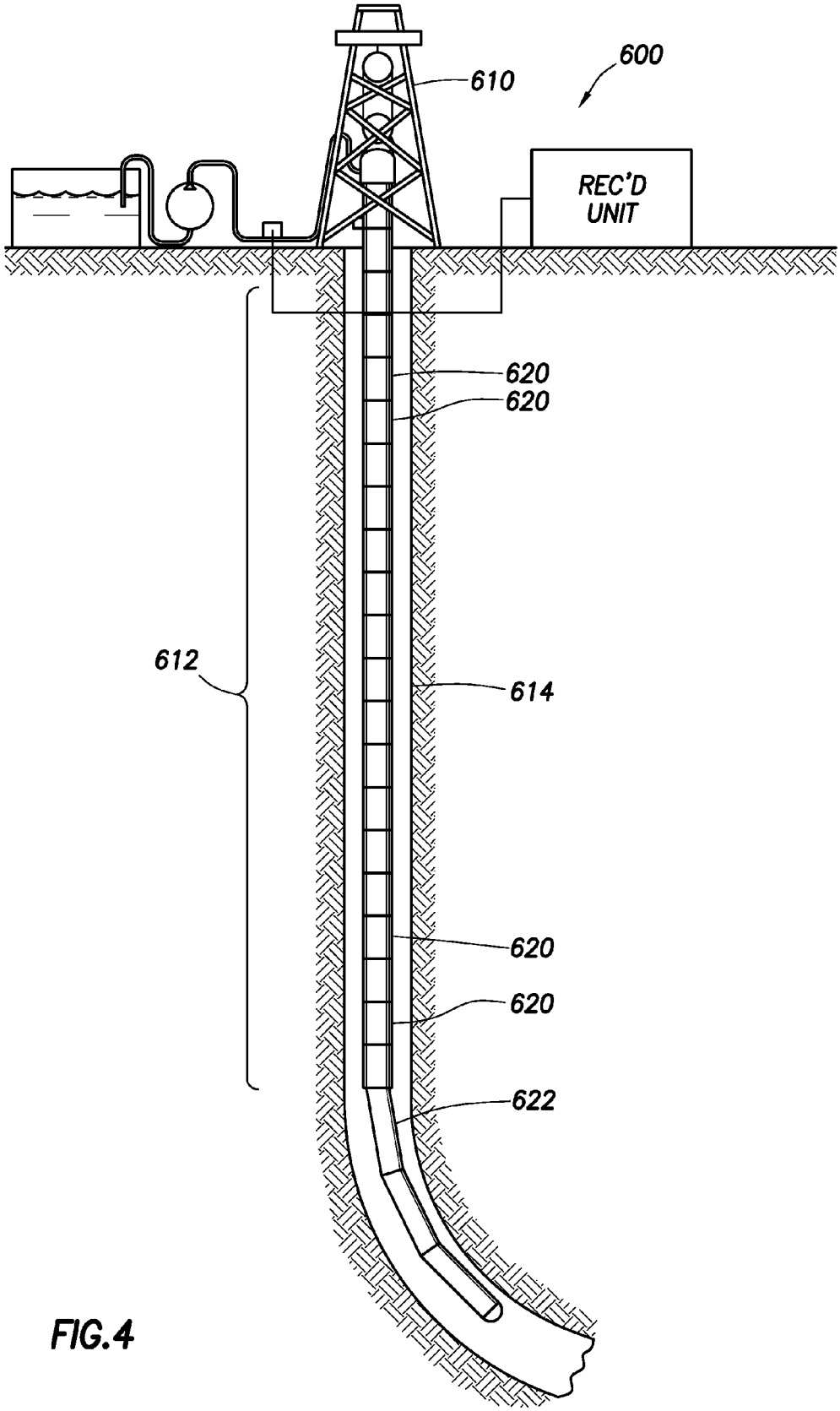
FIG. 4 shows a side view of a wellsite having a drilling rig in accordance with one or more embodiments of the present disclosure.

Referring now to FIG. 4, a side view of a wellsite 600 having a drilling rig 610 in accordance with one or more embodiments of the present disclosure is shown. In this embodiment, a borehole 614 may be formed within a subsurface formation F, such as by using a drilling assembly, or any other method known in the art. Further, in this embodiment, a wired pipe string 612 may be suspended from the drilling rig 610. The wired pipe string 612 may be extended into the borehole 614 by threadably coupling multiple segments 620 (i.e., joints) of wired drill pipe together in an end-to-end fashion. As such, the wired drill pipe segments 620 may be similar to that as described within U.S. Pat. No. 6,641,434, filed on May 31, 2002, entitled "Wired Pipe Joint with Current-Loop Inductive Couplers," and incorporated herein by reference.

Wired drill pipe may be structurally similar to that of typical drill pipe, however the wired drill pipe may additionally include a cable installed therein to enable communication through the wired drill pipe. The cable installed within the wired drill pipe may be any type of cable capable of transmitting data and/or signals therethrough, such an electrically conductive wire, a coaxial cable, an optical fiber cable, and or any other cable known in the art. Further, the wired drill pipe may include having a form of signal coupling, such as having inductive coupling, to communicate data and/or signals between adjacent pipe segments assembled together.

As such, the wired pipe string 612 may include one or more tools 622 and/or instruments disposed within the pipe string 612. For example, as shown in FIG. 4, a string of multiple borehole tools 622 may be coupled to a lower end of the wired pipe string 612. The tools 622 may include one or more tools used within wireline applications, may include one or more LWD tools, may include one or more formation evaluation or sampling tools, and/or may include any other tools capable of measuring a characteristic of the formation F.

The tools 622 may be connected to the wired pipe string 612 during drilling the borehole 614, or, if desired, the tools 622 may be installed after drilling the borehole 614. If installed after drilling the borehole 614, the wired pipe string 612 may be brought to the surface to install the tools 622, or, alternatively, the tools 622 may be connected or positioned within the wired pipe string 612 using other methods, such as by pumping or otherwise moving the tools 622 down the wired pipe string 612 while still within the borehole 614. The tools 622 may then be positioned within the borehole 614, as desired, through the selective movement of the wired pipe string 612, in which the tools 622 may gather measurements and data. These measurements and data from the tools 622 may then be transmitted to the surface of the borehole 614 using the cable within the wired drill pipe 612. For example, one or more of the tools 622 may include a downhole tool of a type similar to the downhole tool described in FIGS. 5A and 5B herein. Furthermore, a wave detector in accordance with embodiments disclosed herein may be included within the wellsite 600, such as in one or more locations along the wired pipe string 612, and/or within a coring tool implemented in one or more downhole tools 622.

Figure 5A:
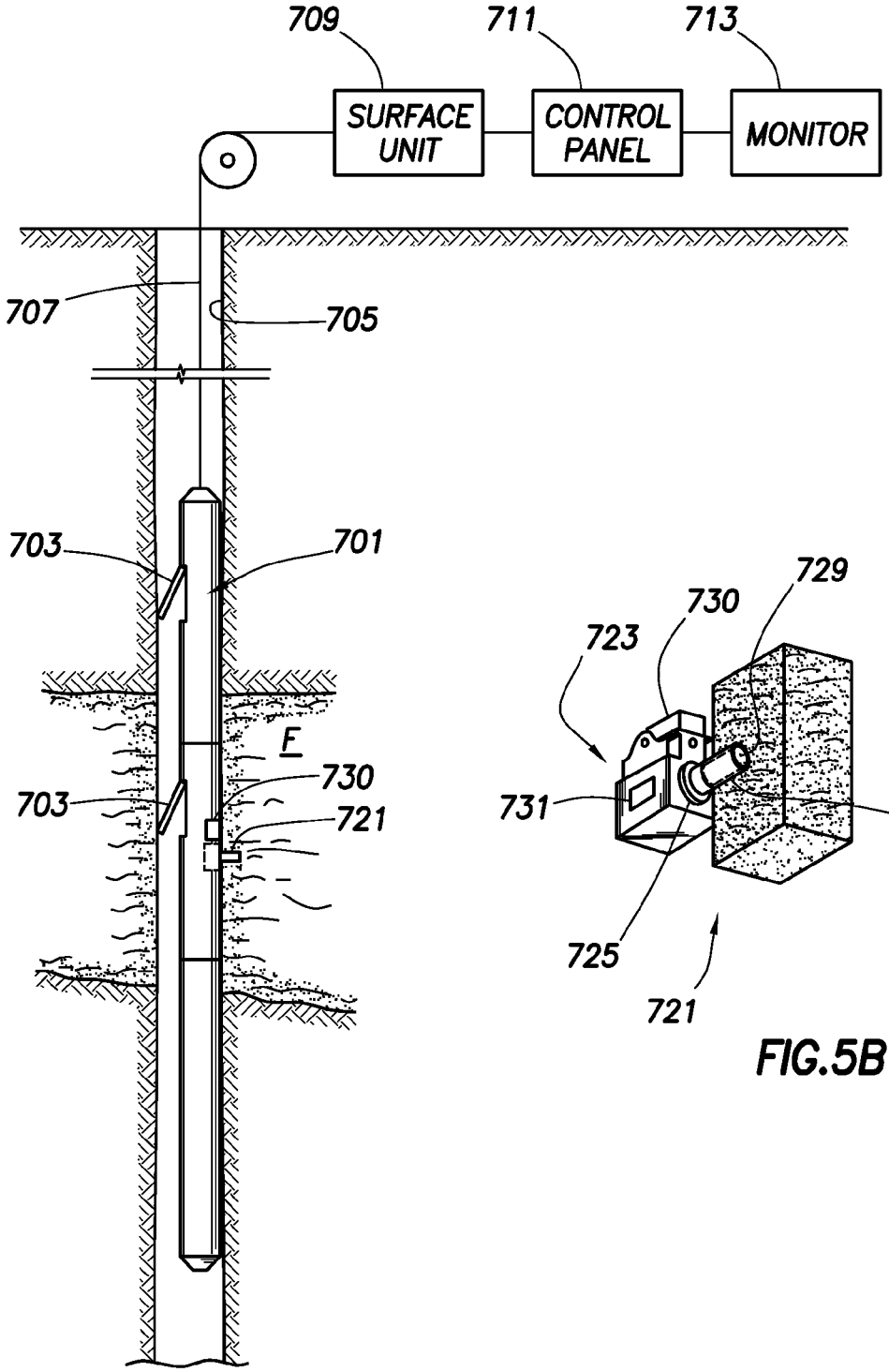
FIGS. 5A and 5B show multiple views of a coring tool and wave detector in accordance with one or more embodiments of the present disclosure.
Figure 5B:
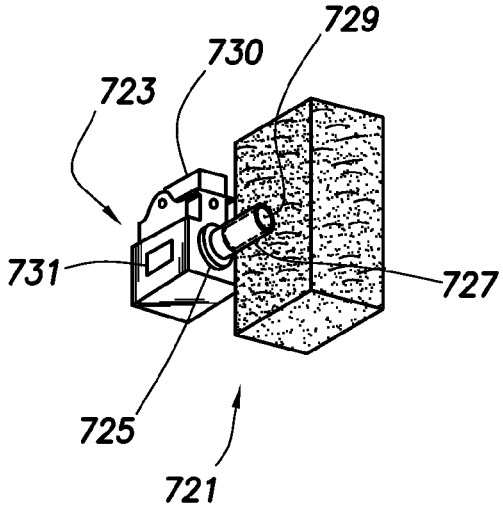

Referring now to FIGS. 5A and 5B, multiple views of a downhole tool 701 in accordance with one or more embodiments of the present disclosure are shown. Particularly, in FIG. 5A, a side view of the tool 701 is shown, in which the tool 701 may include a wave detector 730 and a coring tool 721. Further, FIG. 5B shows a perspective view of the wave detector 730 and the coring tool 721.

In this embodiment, the tool 701 may be suspended within a borehole 704 formed within a subsurface formation F, in which the tool 701 may be suspended from an end of a multi-conductor cable 707 located at the surface of the formation F. As such, the cable 707 may enable the wireline tool 701, the wave detector 730, and the coring tool 721 to be electrically coupled to a surface unit 709, in which the surface unit 709 may further include a control panel 711 and/or a monitor 713. The surface unit 709 may be able to provide electrical power to the wave detector 730 and the coring tool 721 and may enable monitoring of the status of the wave detector 730 and other activities of downhole equipment within the tool 701. Further, the cable 707 may be able to provide control over the activities of the wave detector 730, the coring tool 721, and other downhole equipment within the tool 701. The cable 707 may also be configured to provide data communication between the tool 701 (and the wave detector 730) and the surface unit 709. Alternatively, the tool 701 may be an autonomous powered downhole tool.

As shown, the wave detector 730 may be disposed within an elongate housing of the wireline tool 701 such that the wave detector 730 may he disposed downhole within the borehole 704. Further, the coring tool 721 may be disposed within the elongate housing of the wireline tool 701, proximate to the wave detector 730. The coring tool 721 may include a coring assembly 723, which may include one or more motors 725 that may be powered, for example, through the use of the power provided from the cable 707. The coring tool 721 may further include a coring bit 727, in which the coring bit 727 may have an open end 729 for cutting into the formation F and receiving, a coring sample. Further, the coring tool 721 may be able to extend and retract the coring bit 727 into and out of the coring tool 721, and may also be able to rotate the coring bit 727 against the wall of the borehole 704. The coring tool 721 may include a wave detector 731.

FIGS. 5A and 5B show the wave detector 730 and the coring tool 721 in the coring position, in which the coring tool 721 is used to drill into the wall of the borehole 704 and receive a coring sample. Particularly, the coring bit 727 may be rotated by the motor 725, in which the coring bit 727 receives the coring sample into the coring bit 727 through the open end 729. During this process, the coring bit 727 generates vibrations within the coring tool 721 and interacts with the formation F, generating seismic/acoustic vibrations in the formation. The wave detector 730 may record these vibrations generated while drilling caused both by the mechanical vibrations of the coring tool 721 and/or the vibrations that result from the interaction of the coring bit 727 with the surrounding rock of formation F.

As shown, the tool 701 may include one or more pistons 703 (e.g., anchoring shoes) that may be able to extend from the housing of the tool 701 and engage the wall of the borehole 704. As such, this may enable the pistons 703 to provide stability to the tool 701, the wave detector 730, and the coring tool 721, particularly when the coring tool 721 is drilling into the formation F. Further, the coring tool 721 may include at least two motors, in which one motor may be used to rotate and apply torque to the coring bit 727, and the other may be used to extend/retract and apply weight on the coring bit 727. Further, though the embodiments shown in Figures 5A and 5B show the cable 706 used to provide power to the wave detector 730 and the coring tool 721, those having ordinary skill in the art will appreciate that other methods may be used to provide power downhole, such as by the use of a battery, a power cell, and/or an electrically charged accumulator disposed downhole.

As such, a coring tool may be included within one or more of the embodiments shown in FIGS. 1-5B, in addition to being included within other tools and/or devices that may be disposed downhole within a formation. The coring tool, thus, may be used to extract one or more coring samples from the borehole of a formation. The coring tool may be an axial coring tool and/or a sidewall coring tool, in which the coring tool includes a coring bit that may be used to extract a coring sample from the wall of the borehole. As shown in the following figures, only a sidewall coring tool is shown. However, those having ordinary skill in the art will appreciate that other coring tools may also be included within one or more embodiments without departing from the scope of the present disclosure.

A coring tool in accordance with one or more embodiments of the present disclosure may include, at least, a coring bit movably attached to the coring tool. For example, the coring bit may be able to extend and retract from the coring tool such that the coring bit may be able to be received within a wall of a borehole. Further, the coring bit may be able to rotate with respect to the coring tool, such as when the coring bit is extended from the coring tool. This may enable the coring bit to drill into and collect a coring sample from the wall of the borehole when disposed downhole. Furthermore, the coring bit may be able to move with respect to the coring tool, such as by having the coring bit revolve between positions when disposed within the coring tool. For example, the coring bit may further be able to revolve between a coring position and an ejection position within the coring tool.

Furthermore, a wave detector, and one or more methods of using a wave detector, in accordance with the present disclosure may be included within one or more of the embodiments shown in FIGS. 1-5B, in addition to being included within other tools and/or devices that may be disposed downhole within a formation. The wave detector, thus, may be used in concert with movement and/or wave generators to extract information from a formation. As used herein, movement may include vibrations of the tools only or vibrations within the formation including seismic and acoustic vibrations and/or waves. The wave detector may be a waveform detector, a wave transducer, a vibration transducer, an accelerometer, a velocimeter, a force detector, a pressure detector, a displacement detector, other abstract measurement devices in which the measurement may be mathematically transformed to acceleration or force, and/or any other acoustic or seismic sensor known in the art, and/or a plurality of such instruments and/or sensors. For example, an accelerometer may convert detected acceleration (or movement) into an electric signal through use of a piezoelectric crystal and a mass applying force to the crystal that may be recorded; however, any form of vibration transducer or accelerometer known in the art may be used.

Further, the movement (or wave) generator may be the coring tool or any other seismic or acoustic source. For example, when the coring tool engages a formation in a borehole to extract a sample, motors are run to operate a drill bit. The vibrations generated by the motors may be detected by the wave detector. Further, when the drill bit impacts the borehole wall, vibrations, such as seismic and acoustic waves, may be generated in the formation from the interaction with the drill bit. A wave detector that may be coupled to the formation wall may detect the vibrations that are generated in the formation.

The wave detector and the coring tool may be in communication so that the wave detector may extract information from the movement generated by the movement generators, such as by operation of a coring tool and the movement resulting from the interaction of the coring tool with the formation during drilling for a core sample. For example, the wave detector may be in communication with the coring tool by mechanical and/or acoustic coupling. As used herein, coupling means the state of being attached or engaged with or to another entity. For example, a wave detector may have a coupling to a borehole wall that allows it to record ground motion during acquisition of seismic or acoustic data. Or, for example, a wave detectors may be coupled to a coring tool to allow it to record mechanical or acoustic vibrations generated by operation of a coring bit. Further, as used herein, "decoupled" means the state of being separate from or a lack of attachment or engagement with or to another entity. Furthermore, mechanical coupling may include physical attachment or any other means of mechanical attachment and acoustic coupling may include being in acoustic communication with another entity. For example, a wave detector may be mechanically attached to a coring tool and further may be in acoustic communication with a formation by being pressed against the formation.

The wave detector may also be in acoustic communication with the formation. Those having skill in the art will appreciate that a core sample is not required to be extracted by the coring tool for the wave detector to detect movement or waves generated by a coring tool. Further, the wave detector may be disposed within a downhole tool, but acoustically decoupled from the coring tool. In this case, the wave detector may be mechanically coupled to the downhole tool, but acoustically decoupled from the movement generator (coring tool). In this example, the wave detector would be configured to not detect the noise generated by the coring tool, but would only detect the movement in the formation or waves propagating therethrough.

Information output by the wave detector may include the movement of the coring tool, the movement of the formation, and/or any other type of information traditionally gathered by a wave detector. This information may then be output in one or more output signals, such as an analog signal. An analog signal may then be converted to a digital signal and recorded as seismic (or acoustic) traces in the form of a series of time samples. To convert an analog signal to a digital signal, an A/D device may be used. For example, as noted above, an electric signal through use of a piezoelectric crystal and a mass applying force to the crystal that may be recorded. The electric signal output by the wave detector may then be input into the A/D device. For example, analog voltage (or current) generated in the electrical signal may be converted to a digital number proportional to the magnitude of the voltage or current. However, as noted, other A/D devices and methods may be employed to convert an analog signal into a digital signal. Alternatively, an analog detector may be omitted, and a direct digital vibration sensor may be employed.

The analog signals may be converted to digital signals downhole within the downhole tool by operation of a processor. The processor may be part of the wave detector or may be disposed anywhere in the downhole tool. Further, the analog signals may be communicated to the surface for conversion by surface units. In this case the signal may be conveyed through the wireline that the downhole tool is coupled tool, or may be communicated by other downhole data transfer methods known in the art. Further, the analog signals may be stored in the tool during the downhole operation. After completion and removal of the downhole tool from the borehole, the analog data may be removed from the wave detector or other recording device that is located in the downhole tool.

In accordance with one or more embodiments of the present disclosure, a wave detector may be disposed within the coring tool. A sensor disposed within the coring tool may be the only downhole wave detector, or may be one of a plurality, in which additional sensors may be disposed throughout the downhole tool, remote from the coring tool. Accordingly, measurement of the movement generated by the coring tool may be measured. Furthermore, the wave detector disposed within the coring tool may be able to determine movement of the formation during coring due to the interaction of the coring bit with the formation.

In accordance with one or more embodiments of the present disclosure, additional wave detectors may be employed. The additional wave detectors may operate as described above, but may be decoupled from the downhole tool and only coupled to the formation. Accordingly, additional wave detectors may be disposed on a wireline apart from the downhole tool, on drill pipe or wired drill pipe not containing the downhole tool, or disposed throughout the borehole by any other means. As such, wave detectors may be disposed throughout the borehole and may extract information about movement of the formation at different locations. Further, the additional wave detectors may be correlated to movement detected by wave detectors coupled to the downhole tool, and may further be used to remove the noise generated by the tool and observe only the movement of the formation.

In accordance with one or more embodiments of the present disclosure, additional wave detectors may be disposed in boreholes different from the borehole that the coring tool is disposed in. Additional boreholes may be drilled near the borehole with the coring tool, and wave detectors may be disposed down these additional boreholes. Accordingly, a coring tool may be disposed down a first borehole, and operated to extract a core sample. The wave detectors disposed in additional boreholes may detect movement of the formation as generated by the coring tool during operation. Furthermore, additional wave detectors may be disposed on the surface of the wellsite to detect movement generated by the coring tool. The wave detectors disposed on the surface of the wellsite may be placed in a grid-like manner, as described in U.S. Pat. No. 5,148,407, filed Oct. 29, 1990, entitled "Method for Vertical Seismic Profiling," and incorporated herein by reference.

Figure 6:
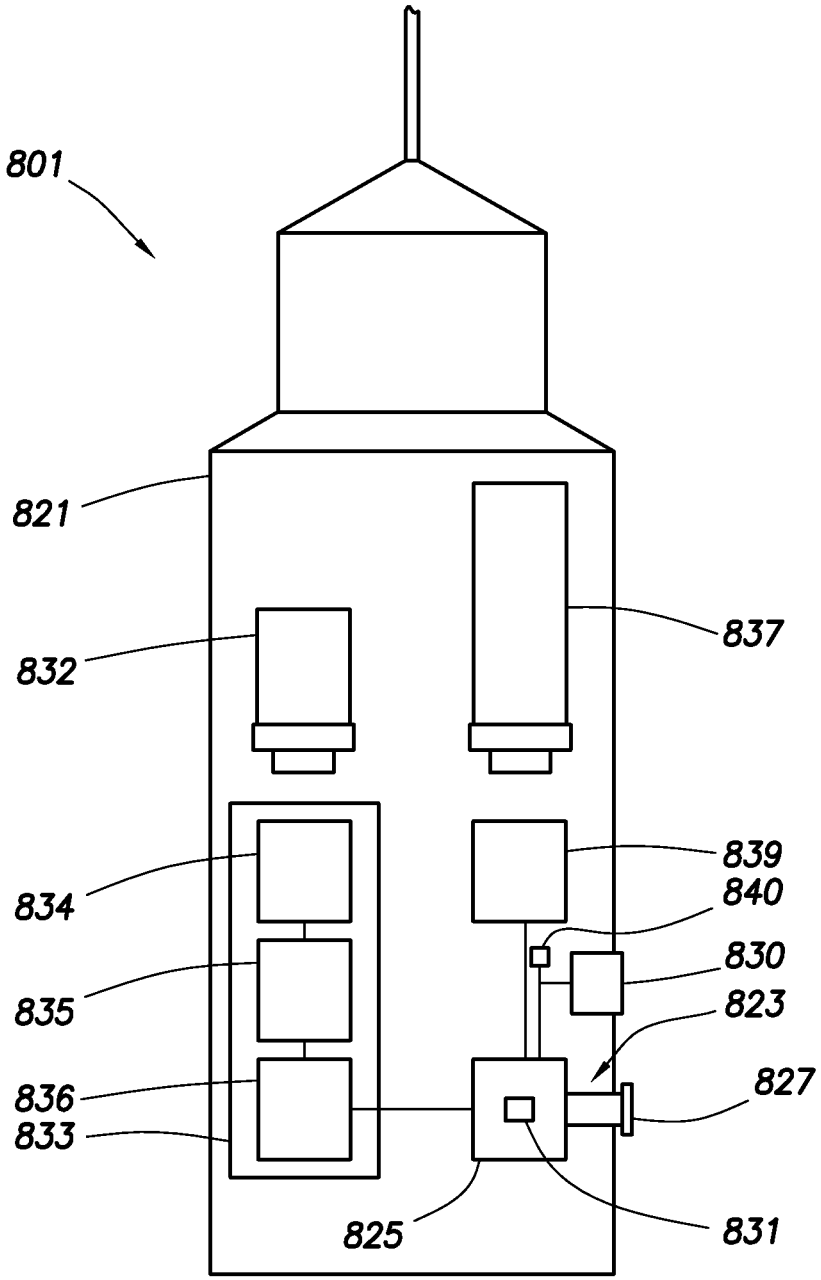
FIG. 6 shows a schematic view of a downhole tool in accordance with one or more embodiments of the present disclosure.

Referring now to FIG. 6, a schematic view of a downhole tool 801 in accordance with one or more embodiments of the present disclosure is shown. As with the above embodiment, the downhole tool 801 may include a coring assembly 823 with a coring motor 825, and further may include a coring bit 827 operatively coupled to the motor 825. As such, the motor 825 may be able to drive the coring bit 827 such that the coring bit 827 may be able to drill into the formation (e.g., wall of a borehole) and obtain a coring sample. The downhole tool 801 may further include a wave detector 830 which may be mechanically and/or acoustically coupled to the coring assembly 823. Furthermore, a wave detector 831 may be disposed within the coring assembly 823.

When driving the coring bit 827 into the formation, the coring bit 827 may be pressed against and into the formation while also being rotated. Thus, the coring tool 821 may apply a weight-on-bit ("WOB") (e.g., a force that presses the coring bit 827 into the formation) and a torque on the coring bit 827. As such, and as shown in FIG. 6, the WOB applied to the coring bit 827 may be generated by a motor 832, in which the motor 832 may be an AC motor, a brushless DC motor, and/or any other power source, and a control assembly 833. As shown, the control assembly 833 may include a hydraulic pump 834, a valve 835, such as a feedback flow control valve, and a piston 836. In such an embodiment, the motor 832 may be used to supply power to the hydraulic pump 834, in which the flow of hydraulic fluid from the pump 834 may be controlled and/or regulated by the valve 835. Pressure then from the hydraulic fluid from the pump 834 may be used to drive the piston 836, in which the piston 836 may be used to apply a WOB upon the coring bit 827. Further, when WOB is applied to the coring bit 827, the wave detector 830 may also be pressed against the formation, thereby allowing acoustic communication between the wave detector 830, the coring assembly 823, and the formation F. Further, a storing and/or recording device or medium 840, such as a memory, may be provided within the coring tool 821 to provide storage for data collected/output by one or more of wave detectors 830 and 831.

Further, in one or more embodiments, torque for the coring bit 827 may be supplied by another motor 837, in which the motor 837 may also be an AC motor, a brushless DC motor, and/or any other power source, and a gear pump 839. The motor 837 may be used to drive the gear pump 839, in which the gear pump 839 may be used to supply a flow of hydraulic fluid to the coring motor 825. As such, the coring motor 825, which thus may be a hydraulic coring motor, may impart a torque to the coring bit 827 that enables the coring bit 827 to rotate. As the motors 825 and 837 and the gear pump 839 operate, vibrations may be generated within the coring tool 821 and the downhole tool 801. The vibrations may be detected by the wave detectors 830 and 831, for example, in the form of acoustic or seismic vibrations.

A downhole tool in accordance with one or more embodiments disclosed herein may include one or more sensors for detecting the presence and/or geophysical properties of coring samples obtained from the formation. For example, a downhole tool may include a geophysical-property measuring unit that may connected by a bus of the tool to a telemetry unit, thereby enabling the tool to transmit data to a data acquisition and processing apparatus located at the surface. The geophysical-property measuring unit may be a gamma-ray detection unit, NMR sensors, electromagnetic sensor, and/or any other device known in the art. Additional details regarding a geophysical-property measuring unit that may be used within one or more embodiments of the present disclosure are provided in U.S. Patent Application Publication No. 2007/0137894 in the name of Fujisawa et al., which is incorporated herein by reference in its entirety.

As such, in accordance with one or more embodiments disclosed herein, a wave detector in accordance with embodiments disclosed herein may enable the downhole tool to measure movement properties, which may include seismic and/or acoustic, of a formation during the extraction of a core sample or operation of a coring tool. Further, in one or more embodiments the wave detector(s) may be disposed in the coring tool or outside the coring tool, but within the downhole tool.

Figure 7:
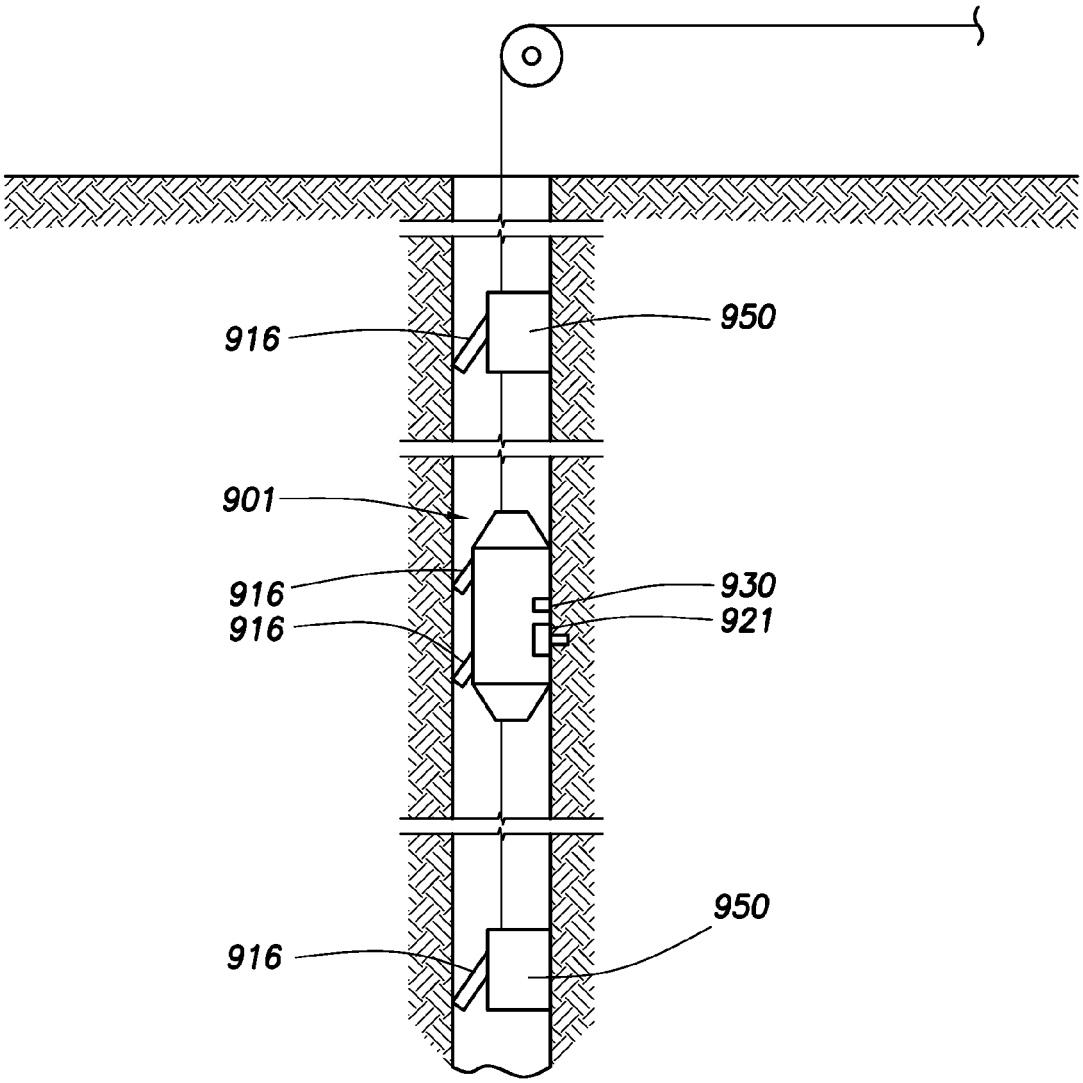
FIG. 7 shows a schematic side view of a wellsite having multiple wave detectors in accordance with one or more embodiments of the present disclosure.

Referring to FIG. 7, a schematic side view of a wellsite having multiple wave detectors in accordance with one or more embodiments of the present disclosure is shown. A downhole tool 901, as well as one or more wave detectors 950 decoupled from the tool 901, may be disposed in a borehole. As shown, the decoupling may be accomplished by placing the wave detectors 950 on the same wireline as the downhole tool 901, but at different locations within the borehole, or by packaging the wave detectors in a similar way to that in the versatile seismic imager or VSI, a trademark of Schlumberger Technology Corporation. The downhole tool 901 may include a coring tool 921 and an onboard wave detector 930, which may be within the coring tool 921, as shown, or merely within the downhole tool 901. In this case, the wave detector 930 may be mechanically and/or acoustically coupled to the downhole tool 901. Further, the wave detector 930 may be mechanically and/or acoustically coupled to the coring tool 921, within the downhole tool 901. The downhole tool 901 may be pressed against the formation of the borehole wall as described above, which may put the wave detector 930 in acoustic communication with the formation.

The wave detectors 950 may be displaced vertically from the downhole tool 901. Further, the wave detectors 950 may be pressed against the formation of the borehole wall by similar means, such as pistons 916, which may put the wave detectors 950 in acoustic communication with the formation. As shown, the wave detectors 950 may be disposed above and below a downhole tool 901 within a borehole, but one skilled in the art would appreciate that the wave detector(s) 950 may be disposed only above or only below the downhole tool 901. Furthermore, as shown, the wave detectors 950 may be disposed on the same wireline as the downhole tool 901. However, the wave detectors 950 may be disposed on a second wireline, disposed down the same borehole, without deviating from the scope of the present disclosure.

Figure 8:
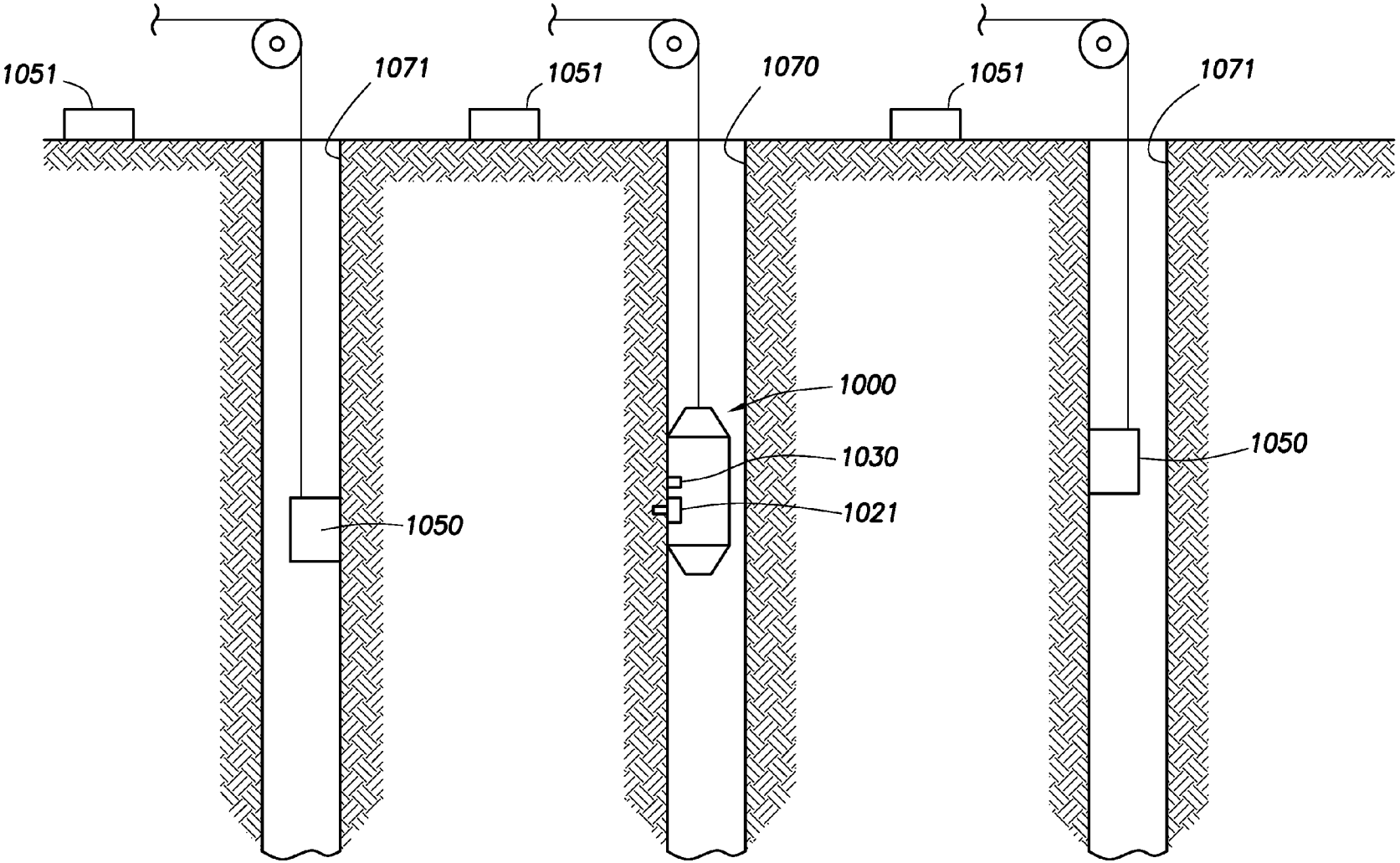
FIG. 8 shows a schematic side view of a wellsite having multiple boreholes in accordance with one or more embodiments of the present disclosure.

Referring now to FIG. 8, a schematic side view of a wellsite having multiple boreholes in accordance with one or more embodiments of the present disclosure is shown. A downhole tool 1001 may be disposed in a first borehole 1070. One or more wave detectors 1050 may be disposed in one or more nearby boreholes 1071 and one or more wave detectors 1051 may be located on the surface. The downhole tool 1001 may include a coring tool 1021 and an onboard wave detector 1030. The downhole tool 1001 may be pressed against the formation of the borehole wall, as described above. The surface wave detectors 1051 may be placed in a grid pattern, as described above. When the coring tool 1021 of the downhole tool 1001 is operated, movement generated by the interaction of the coring tool 1021 with the formation may be detected by one or more of the wave detectors 1030, 1050, and 1051. Accordingly, information regarding the formation around the borehole 1070 may be extracted using one or more of the wave detectors 1030, 1050, and 1051. Further, while the nearby wellbore 1071 are shown separate from the first wellbore 1070 in FIG. 8, the nearby wellbores may alternatively branch off the first wellbore, such as sidetrack wellbores, without departing from the scope of the present disclosure.

One having skill in the art will appreciate that embodiments disclosed herein may be combined for desired information collecting purposes. For example, embodiments as described in FIGS. 7 and 8 may be combined to have wave detectors disposed in the downhole tool, within the same borehole as the downhole tool, in boreholes near the borehole with the downhole tool, and/or on the surface. Further, although one wave detector 1050 is shown in each nearby borehole 1071 of FIG. 8, one skilled in the art would appreciate that multiple wave detectors 1050 may be disposed in each of the nearby boreholes 1070. Further, a plurality of the surface wave detectors 1051 may, for example, be disposed in a grid-like manner as described above.

Figure 9:
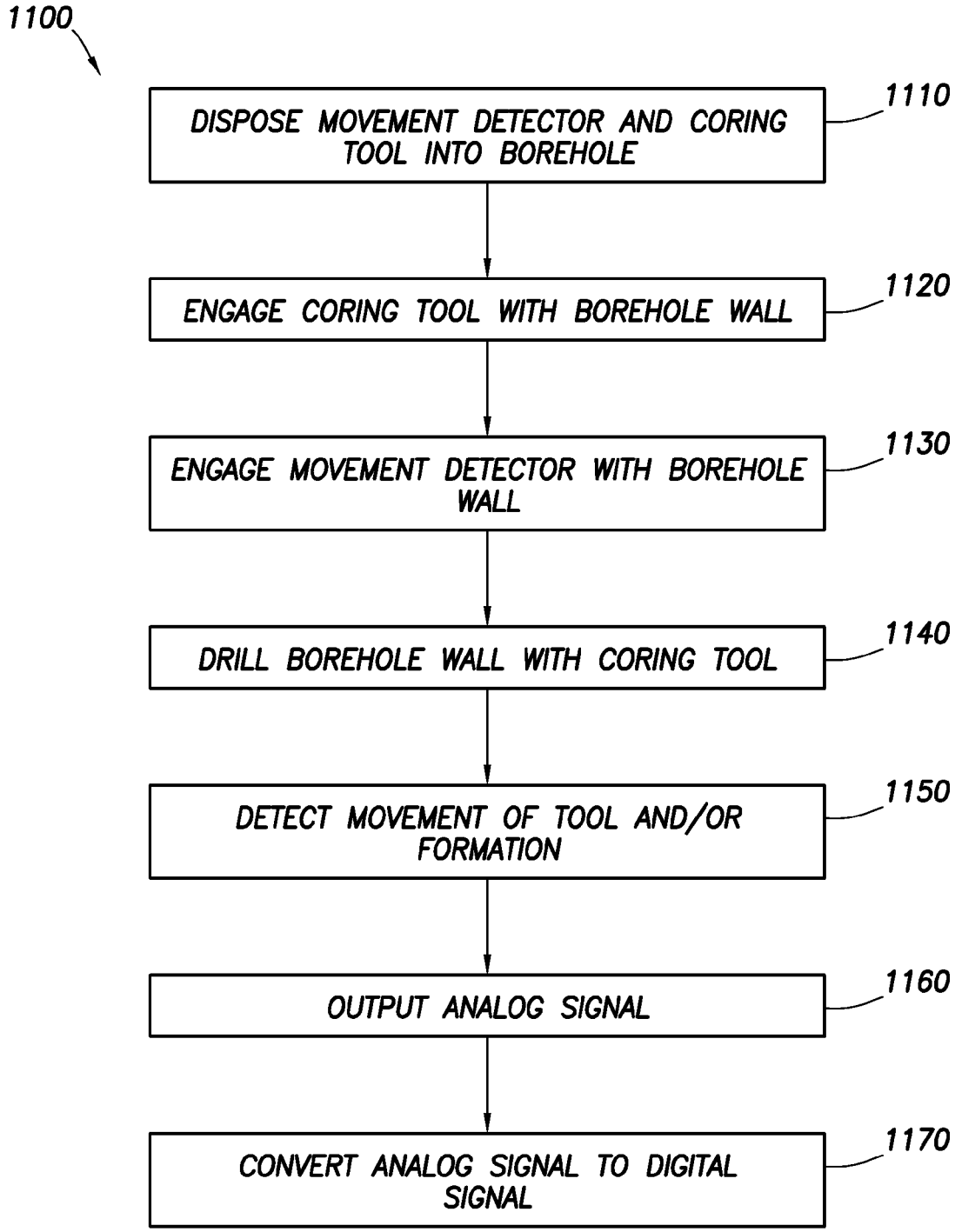
FIG. 9 shows a flow chart of a method to drill with a coring tool and make measurements in accordance with one or more embodiments of the present disclosure.

Referring now to FIG. 9, a flow chart of at least a portion of a method 1100 to drill with a coring tool and make measurements in accordance with one or more embodiments of the present disclosure is shown. The example method 1100 disclosed herein may provide for one or more of the following advantages. In accordance with one or more embodiments of the present disclosure, the method 1100 may be performed using one or more of the embodiments shown in FIGS. 1-6, in addition to being performed with other tools and/or devices that may be disposed downhole within a formation. Further, the method 1100 may be used to determine formation information through observation of the movement generated by a coring tool.

First, the method may include disposing a coring tool and one or more wave detectors into a borehole 1110. In disposing the coring tool and one or more wave detectors into a borehole, a wireline coupled to the tool and detector may be employed. Further, the wave detectors and the coring tool may be coupled together, which may be by mechanical and/or acoustic coupling. Alternatively, the tool and detectors may be disposed on pipe sections of a drill string, or may be disposed on wired pipe sections of a wired drill string. The tool and detectors may then be lowered into a borehole to a desired depth or location to perform analysis of the formation.

Next, the coring tool may be engaged with the formation to extract a core sample 1120. Motors of the coring tool may be powered by the wireline or other downhole power sources, as described above. The motors may be operated to place a coring bit into position with the surface of the downhole formation.

Further, the wave detectors may also be engaged with the formation 1130. The wave detectors may be disposed within the coring tool, and, therefore, engage with the formation through the engagement made by the coring tool. Alternatively, the wave detectors may be disposed on an outside surface of a downhole tool, so that when the coring tool is made to engage with the formation, the wave detectors may also be engaged with the formation. Furthermore, the wave detectors may have mechanisms onboard, such as the pistons described above, to enable engagement of the detector to the formation.

Both the coring tool and the wave detectors may further be anchored to the formation after engagement is achieved or to achieve engagement. For example, pistons, as described above, may be employed to allow for engagement and for anchoring. Moreover, as shown in flow chart 1100 and described above, the coring tool engages with the formation prior to engagement of the wave detectors to the formation. However, one skilled in the art will appreciate that the engagement of the coring tool and the wave detectors with the formation may be made in any order or made simultaneously.

A core sample may then be extracted 1140, in which a coring bit of the coring tool may be used to drill into the wall of the borehole. Motors of the coring tool may be operated to apply torque or other force to a coring bit. The coring bit may then rotate, and WOB may be applied as discussed above. As the coring bit engages with the formation, vibrations may result in the formation. Further, as power and force are applied to the coring bit, vibrations in the coring tool, and the downhole tool housing the coring tool, may result.

During extraction of the core sample, while the coring bit is drilling, the wave detectors may be operated to detect waves, such as detecting movement forces or vibrations 1150. The movement detected may include the movement generated by the coring tool within the tool body and/or the movement generated by the interaction of the coring tool with the formation and may further include acoustic or seismic vibrations. As such, when drilling into the borehole, the coring bit may attempt to retrieve a coring sample from a formation and the wave detector may collect signals of movement that may be used to determine characteristic of the formation cored.

The signals collected at step 1150 may be output as analog signals at 1160, such as described above, or may be digital signals. The analog or digital signals may be output by an accelerometer or other movement detecting device known in the art or future-developed. The analog signals may then be converted 1170 to digital signals and recorded as a series of time samples, as described above. The conversion may take place in the wave detector or any other downhole processing device. Further, the analog or digital signals may be communicated to the surface by wireline or other communication means to be analyzed. Further, the analog or digital signal may be stored in the wave detector or downhole tool and extracted at the surface after withdrawal from the borehole. Furthermore, the analog or digital signal may be analyzed downhole using processors or other analytical tools known in the art.

One or more embodiments of the present disclosure may include disposing additional wave detectors into the same borehole as the coring tool. These additional sensors may be disposed above and/or below the coring tool, and additionally, a wave detector may be disposed in a housing that encloses the coring tool. Furthermore, additional steps may include disposing additional wave detectors in one or more boreholes that are near the borehole that the coring tool is disposed in. Further, additional steps to the method may include disposing wave detectors on the surface near the borehole that the coring tool is disposed in. As such, a variety of configurations may be employed to extract movement information from a formation through operation of a coring tool.

Further, in accordance with one or more embodiments of the present disclosure, the coring tool and coring tool drill bit may be used as a seismic/acoustic source to extract information about a formation. The information extracted may include: micro-seismic tomography, downhole velocity profile, seismic profiling, and/or any other information related seismic, acoustic, or waveforms.

The micro-seismic tomography may be extracted, for example, by use of wave detectors deployed in nearby boreholes and at least one wave detector attached to the coring tool in accordance with embodiments disclosed herein. A micro-seismic source may be generated during operation of the coring tool and the wave detector attached to the tool, such as an accelerometer, or other devices as previously discussed, may monitor the source (the coring tool) directly. Additional wave detectors, disposed in nearby boreholes, may also observe the micro-seismic source remotely. This may be done in a multi level seismic system setup similar to Hydraulic Fracture Monitoring or StimMAP, provided by Schlumberger Limited. In this setup, for example, as a first step for processing the signals, the data collected by the remote detectors may be correlated with the data provided by the accelerometer attached to the coring tool to provide transit time information.

Furthermore, a downhole velocity profile may be generated through use of wave detectors disposed within a single borehole in accordance with embodiments disclosed herein. In this case, a coring tool with a wave detector may be disposed within a downhole tool on a wireline or on a segment of drill pipe. Additional wave detectors may be disposed above and/or below the downhole tool, on wireline, or on different segments of drill pipe. The additional wave detectors may be located at positions determined by a frequency range to be recorded. Accordingly, as the coring tool may be operated, the remote wave detectors may detect the movement generated by the coring tool and a velocity of sound in the rock may be detected to extract a velocity profile.

Moreover, the information extracted from wave detector signals may include: rotation speed of the drill bit, information regarding the functionality of the drill system such as bit wear, information regarding properties of the rock penetrated by the drill bit, the relative position of the drill bit system, detection of severing of the extracted core sample, and/or any other information related to vibration, or movement. Further, the information may be in the form of a digital signal. The digital signal may be used as a closed loop control for a drill algorithm.

The rotation speed of the drill bit of the drill bit may be determined, for example, from the frequency analysis of a spectrum of the output signal based upon the measured movement measured with a wave detector. For example, the dominant frequency of the output signal recorded during drilling may be proportional to the rotation speed of the drill bit. Thus, the rotation speed may be computed from a dominant frequency. Further, the relative position of the drill bit system may also be determined from a direct component (DC) of an axial acceleration provided with a wave detector coupled to a drill bit.

Additional information may be measured by the coring tool, such as, the weight on bit and or the torque at bit. The additional information may be used in conjunction with the wave detector signals. For example, a database may be constructed, the database including amplitudes of the wave detector signal during drilling, dominant frequencies of the wave detector signal during drilling, and measured weight on bit and/or torque at bit. The database may also include other information such as bit wear, and rock hardness. To extract information from wave detector signals, the measure wave detector signals, as well as additional information such as, the measured weight on bit and or the measured torque at bit may be compared from record in the database. Based on the comparison, a current bit wear and or a hardness of the formation being drilled may be determined.

The severing of the core from the formation during core sample extraction may also serve to provide useful information. For example, in hard formations, the severing of the core may be viewed as an impulsive micro-seismic event. The severing may be detected by wave detectors and may be used to characterize the formation. By using the micro-seismic event created by the severing of the core, acoustic velocity information may be extracted.

Furthermore, a database of the severing signatures recorded previously by the wave detector may be created. The database may include additional information associating the previously recorded severing signatures to information related to their corresponding cores and/or core extraction operations. The database may be used to compare a newly acquired severing signature with other signatures in the database and infer information regarding, for example, formation core properties (e.g., formation rock hardness), and success of severing operation, among other useful information.

While the present disclosure exemplifies the use of database to extract information about a formation or a core extracting operation by use of wave detectors deployed with a coring tool, those skilled in the art will recognize that other methods be used. For example, empirical models or mathematical relationship, neural network models, among other methods, may be used additionally to or alternatively from databases.

Figure 10:
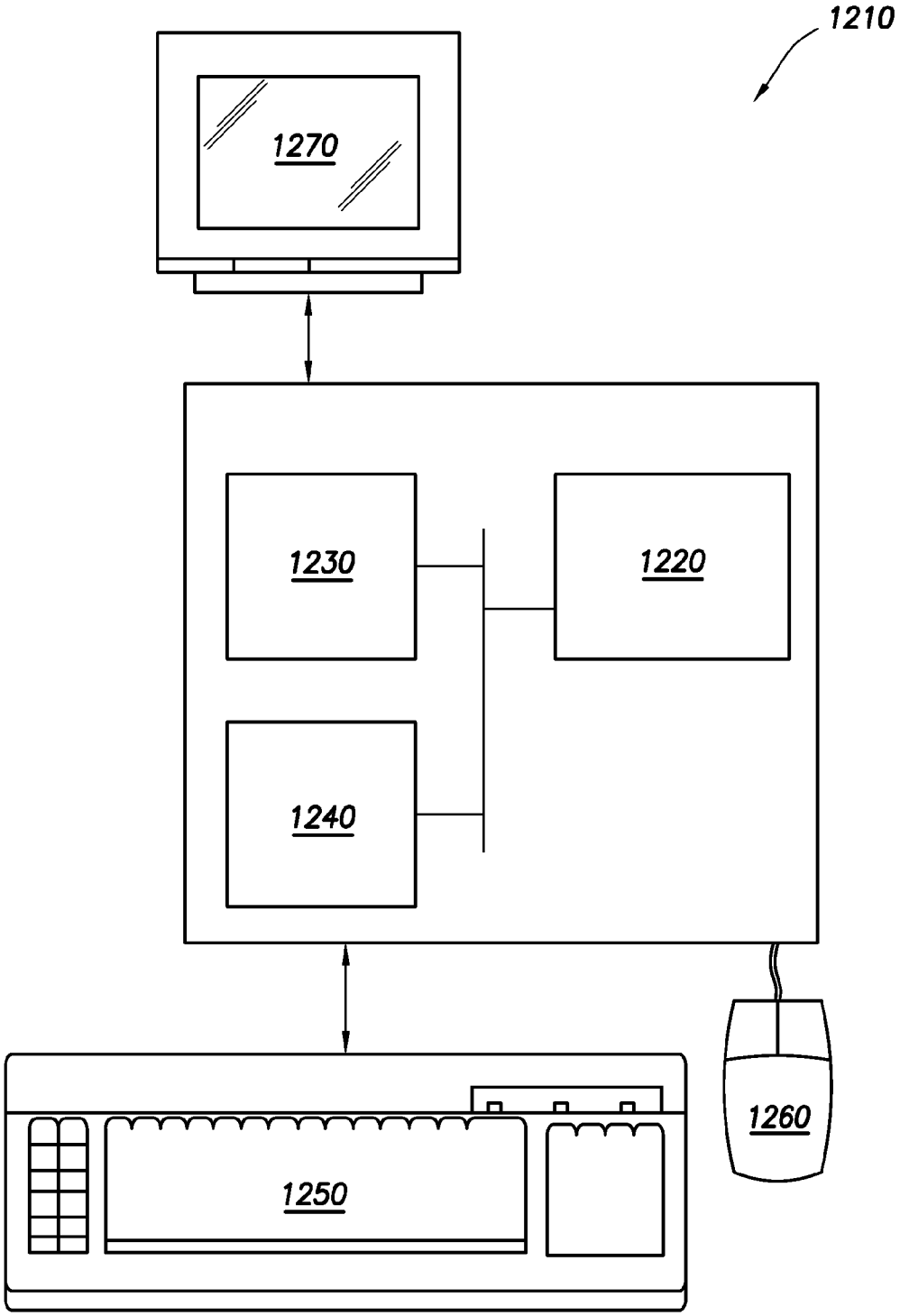
FIG. 10 shows a schematic view of a computer system that may be used in accordance with one or more embodiments of the present disclosure.

Further, aspects of embodiments disclosed herein, such as extracting information about a formation or a core extracting operation by use of wave detectors deployed with a coring tool, may be implemented on any type of computer regardless of the platform being used. For example, as shown in FIG. 10, a networked computer system 1210 that may be used in accordance with an embodiment disclosed herein includes a processor 1220, associated memory 1230, a storage device 1240, and numerous other elements and functionalities typical of today's computers (not shown). The processor 1220 may be configured to read and execute instructions stored, for example, in the memory 1230. Executing the instructions may cause the network computer system 1210 to determine information about a formation and/or a coring operation according to one or more embodiments disclosed herein. The storage device 1240 may be used, for example, for storing databases or other models used to analyze wave detector signals. The networked computer system 1210 may also include input means, such as a keyboard 1250 and a mouse 1260, and output means, such as a monitor 1270. The networked computer system 1210 is connected to a local area network (LAN) or a wide area network (e.g., the Internet) (not shown) via a network interface connection (not shown). Those skilled in the art will appreciate that these input and output means may take many other forms. Additionally, the computer system may not be connected to a network. For example, the input means may be used to acquire wave detector signals according to one or more embodiments disclosed herein. The output means may be used to display, print or store the information extracted from wave detector signals according to one or more embodiments disclosed herein. Further, those skilled in the art will appreciate that one or more elements of aforementioned computer 1210 may be located at a remote location and connected to the other elements over a network. As such, a computer system, such as the networked computer system 1210, and/or any other computer system known in the art may be used in accordance with embodiments disclosed herein, such as by having a computer system coupled to and/or included within a coring tool or wave detector of the present disclosure.

In accordance with one aspect of the present disclosure, one or more embodiments disclosed herein relate to a method to make downhole measurements. The method includes disposing a coring tool in a wellbore, coupling a first wave detector to the coring tool, anchoring the coring tool to a formation surrounding the wellbore, operating the coring tool, measuring movement generated by the coring tool with the first wave detector, and outputting a signal based upon the measured movement measured with the first wave detector.

In accordance with another aspect of the present disclosure, one or more embodiments disclosed herein relate to an apparatus to make downhole measurements in a formation. The apparatus includes a coring tool having a plurality of motors and a coring bit, the motors configured to operate the coring bit to penetrate the formation and a wave detector coupled to the coring tool to measure movement generated by the coring tool.

The foregoing outlines feature several embodiments so that those skilled in the art may better understand the aspects of the present disclosure. Those skilled in the art should appreciate that they may readily use the present disclosure as a basis for designing or modifying other processes and structures for carrying out the same purposes and/or achieving the same advantages of the embodiments introduced herein. Those skilled in the art should also realize that such equivalent constructions do not depart from the spirit and scope of the present disclosure, and that they may make various changes, substitutions and alterations herein without departing from the spirit and scope of the present disclosure.

The Abstract at the end of this disclosure is provided to comply with 37 C.F.R. §1.72(b) to allow the reader to quickly ascertain the nature of the technical disclosure. It is submitted with the understanding that it will not be used to interpret or limit the scope or meaning of the claims.

What is claimed is:

1. A method, comprising:

operating a coring bit of a coring tool to obtain a core sample from a subterranean formation;

measuring movement generated by the coring bit with a wave detector disposed at least partially on an outside surface of the coring tool, wherein the movement is generated by the coring bit while obtaining the core sample; and outputting a signal based on the movement measured with the wave detector;

wherein operating the coring bit comprises operating a first motor to apply a weight-on-bit to the coring bit to drive the coring bit into the subterranean formation and press the wave detector against the subterranean formation separately from the coring bit.

2. The method of claim 1 wherein the wave detector comprises at least one of a vibration transducer, a velocimeter, and a waveform sensor.

3. The method of claim 1 further comprising:

converting an analog signal to a digital signal with a processor; and recording the digital signal as a series of time samples in a memory.

4. The method of claim 1 further comprising sending the signal from the wave detector through a wireline logging cable.

5. The method of claim 1 further comprising storing the signal in a downhole apparatus comprising the coring tool.

6. The method of claim 1 wherein the wave detector is a first wave detector, wherein the signal is a first signal, and further comprising:

measuring movement generated by the coring tool with a second wave detector; and outputting a second signal based on the movement measured with the second wave detector.

7. The method of claim 6 wherein the second wave detector is vertically displaced from the coring tool in the wellbore.

8. The method of claim 6 wherein the second wave detector is located in a second wellbore not containing the coring tool.

9. The method of claim 6 further comprising a third wave detector vertically displaced from the coring tool in the wellbore.

10. The method of claim 1 wherein the coring tool comprises a logging while drilling tool conveyed within a wellbore extending into the subterranean formation via a drill string.

11. The method of claim 10 wherein the drill string comprises wired drill pipe.

12. The method of claim 1 further comprising determining from the output signal whether a core has been severed from the formation.

13. The method of claim 1 further comprising determining from the output signal a rotation speed of a bit of the coring tool.

14. The method of claim 1 further comprising determining from the output signal a bit wear.

15. The method of claim 1 further comprising determining from the output signal a rock hardness.

16. The method of claim 1, wherein operating a coring bit comprises drilling into the subterranean formation with the coring bit, and wherein measuring movement comprises measuring vibrations generated by the coring bit during the drilling.

17. The method of claim 1, wherein operating the coring bit comprises applying the weight-on-bit to enable acoustic communication between the wave detector, the coring tool, and the subterranean formation.

18. The method of claim 1, wherein operating the coring bit comprises applying the weight on bit to a piston of the wave detector to extend the wave detector to the formation separately from the coring bit.

19. An apparatus, comprising:

a downhole coring tool comprising a plurality of motors and a coring bit, wherein the motors are configured to operate the coring bit to penetrate a formation; and a wave detector disposed at least partially on an outside surface of the downhole coring tool and configured to measure movement generated by the coring bit while penetrating the formation to obtain a core sample;

wherein the plurality of motors comprise a first motor configured to apply a weight-on-bit to the coring bit to drive the coring bit into the formation and press the wave detector against the formation separately from the coring bit, and a second motor configured to supply torque for the coring bit.

20. The apparatus of claim 19 wherein the wave detector comprises at least one of a vibration transducer, a velocimeter, and a waveform sensor.

21. The apparatus of claim 19 wherein the wave detector comprises at least one of an accelerometer, a displacement sensor, and a pressure sensor.

22. The apparatus of claim 19, wherein the wave detector is coupled to the coring tool by at least one of mechanical coupling and acoustic coupling.

23. The method of claim 19, wherein the coring bit and the wave detector separately contact the formation.

* * * * *